US011450261B2

(12) United States Patent
Hung et al.

(10) Patent No.: US 11,450,261 B2
(45) Date of Patent: Sep. 20, 2022

(54) IMAGE DISPLAY SYSTEM AND METHOD FOR INCREASING A DATA VOLUME OF A CONTROL SIGNAL THEREOF

(71) Applicant: AVISONIC TECHNOLOGY CORPORATION, Hsin-Chu (TW)

(72) Inventors: Kuo-Ching Hung, Zhudong Township, Hsinchu County (TW); Meng-Chun Lin, Taipei (TW); Han-Min Cho, Hsinchu (TW); Sheng-Fuu Lin, Hsinchu (TW)

(73) Assignee: AVISONIC TECHNOLOGY CORPORATION, Hsin-Chu (TW)

( * ) Notice: Subject to any disclaimer, the term of this patent is extended or adjusted under 35 U.S.C. 154(b) by 0 days.

(21) Appl. No.: 17/330,093

(22) Filed: May 25, 2021

(65) Prior Publication Data

US 2021/0280123 A1 Sep. 9, 2021

Related U.S. Application Data

(62) Division of application No. 16/564,994, filed on Sep. 9, 2019, now Pat. No. 11,049,433.

(Continued)

(30) Foreign Application Priority Data

May 17, 2019 (TW) ..... 108117222

(51) Int. Cl.
*G09G 3/20* (2006.01)
*G09G 3/22* (2006.01)

(52) U.S. Cl.
CPC ..... *G09G 3/2018* (2013.01); *G09G 3/22* (2013.01); *G09G 2310/08* (2013.01)

(58) Field of Classification Search
CPC ..... G09G 2310/08; G09G 2340/045; G09G 2340/10; G09G 2340/125; G09G 2370/04;

(Continued)

(56) References Cited

U.S. PATENT DOCUMENTS

2003/0058210 A1* 3/2003 Yamazaki ..... G09G 3/003 345/88
2012/0169801 A1* 7/2012 Lee ..... G09G 3/3406 345/691

(Continued)

FOREIGN PATENT DOCUMENTS

CN 1270472 A 10/2000
CN 101094376 A 12/2007

(Continued)

*Primary Examiner* — Chun-Nan Lin
(74) *Attorney, Agent, or Firm* — Muncy, Geissler, Olds & Lowe, P.C.

(57) ABSTRACT

An image display system increases the data volume of a control signal in a frame of analog image so as to process an analog image in real time. A method for increasing the data volume of the control signal, which is used in the image display system, includes increasing the time for transmitting the control signal, changing an encoding method of the control signal to increase a data volume which is transmitted in unit time or outputting an analog image signal and the control signal at the same time. Therefore, the data volume of the control signal in a frame of image can be increased.

19 Claims, 17 Drawing Sheets

Related U.S. Application Data

(60) Provisional application No. 62/775,910, filed on Dec. 6, 2018.

(58) Field of Classification Search
CPC ..... G09G 2370/20; G09G 2380/10; G09G 3/2018; G09G 3/22; G09G 5/003; G09G 5/005; G09G 5/14
See application file for complete search history.

(56) References Cited

U.S. PATENT DOCUMENTS

| | | | | |
|---|---|---|---|---|
| 2013/0063550 | A1* | 3/2013 | Ritchey | G09G 5/026 345/207 |
| 2013/0127930 | A1* | 5/2013 | Nishio | G09G 3/3696 345/89 |
| 2014/0368740 | A1* | 12/2014 | Roberts | H04N 5/268 348/705 |
| 2016/0126956 | A1* | 5/2016 | Ryu | G09G 3/3688 327/333 |
| 2017/0309255 | A1* | 10/2017 | Deguzman | G06F 9/451 |
| 2019/0101999 | A1 | 4/2019 | Amer et al. | |

FOREIGN PATENT DOCUMENTS

| | | | |
|---|---|---|---|
| CN | 101742213 | A | 6/2010 |
| CN | 103139553 | A | 6/2013 |
| CN | 103685850 | A | 3/2014 |
| JP | 10-210325 | A | 8/1998 |
| JP | 2001-275031 | A | 10/2001 |
| JP | 2014-22917 | A | 2/2014 |
| KR | 10-0296302 | B1 | 5/2001 |
| TW | 201020563 | A1 | 6/2010 |

* cited by examiner

| 720P | HFP | HSW | HBP | BRW | BUW |
|---|---|---|---|---|---|
| Conventional Technology | 23.70 μs | 0.54 μs | 2.96 μs | 0.44 μs | 2.08 μs |
| The Present Invention | 1.24 μs | 3.44 μs | 4.16 μs | 0.68 μs | 3.24 μs |

Fig. 8

| | Conventional Technology | Variation/Expansion 1 | Variation/Expansion 2 |
|---|---|---|---|
| Parameter | 1280*720-30fps | 1280*800-60fps | 1366*768-60fps |
| Horizontal Front Porch | 1760(Pixel Clock) | 140(Pixel Clock) | 48(Pixel Clock) |
| Horizontal Sync | 40(Pixel Clock) | 286(Pixel Clock) | 32(Pixel Clock) |
| Horizontal Back Porch | 220(Pixel Clock) | 426(Pixel Clock) | 80(Pixel Clock) |
| Carry Frequency of Subcarrier | 74.25*Constant | 71* Constant | 85.5* Constant |
| Pixel Clock | 74.25MHz | 71MHz | 85.5MHz |
| Total Pixel | 3300 | 1440 | 1792 |
| Total Scan Line | 750 | 823 | 798 |
| FPS | 30 | 60 | 60 |

Calculation Equation：One Second = Total Pixel*Total Scan Line*FPS/Pixel Clock

Fig. 9

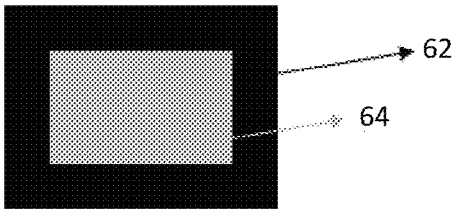
Single Window
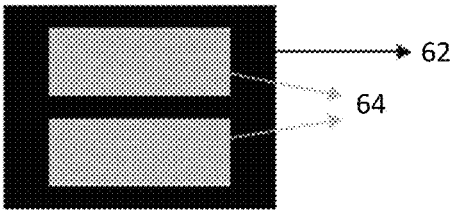
Dual-Windows Divided
(Upper and Lower)
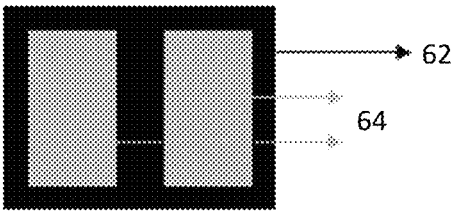
Dual-Windows Divided
(Left and Right)
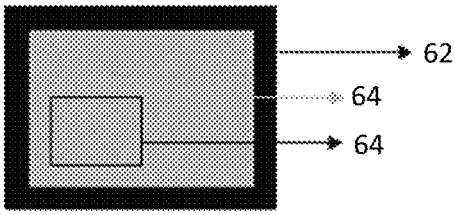
Dual-Windows Divided (Child and
Mother Windows Overlapping)
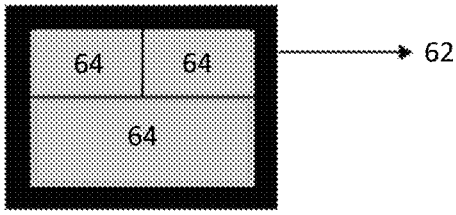
Three Windows Divided
(Upper Window Divided)
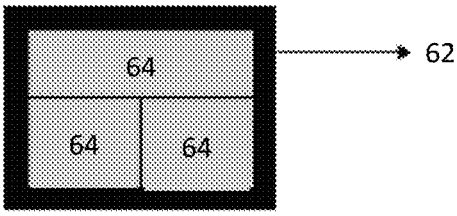
Three Windows Divided
(Lower Window Divided)
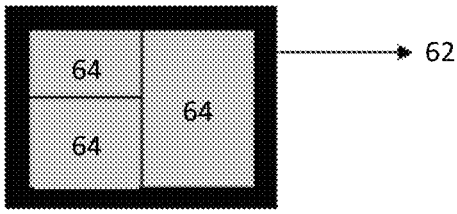
Three Windows Divided
(Left Window Divided)
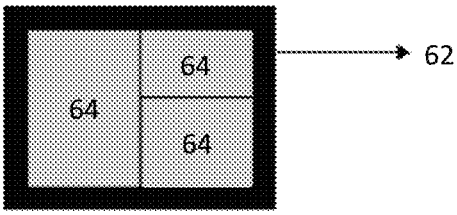
Three Windows Divided
(Right Window Divided)
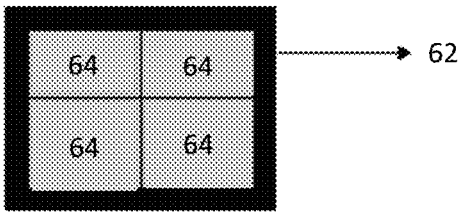
Four Windows Divided
Fig. 21

IMAGE DISPLAY SYSTEM AND METHOD FOR INCREASING A DATA VOLUME OF A CONTROL SIGNAL THEREOF

CROSS REFERENCE TO RELATED APPLICATIONS

This application is a Divisional Application of co-pending application Ser. No. 16/564,994, filed on Sep. 9, 2019, for which priority is claimed under 35 U.S.C. § 120, and this application claims priority of Application No. 108117222 filed in Taiwan on May 17, 2019 under 35 U.S.C. § 119; and this application claims priority of U.S. Provisional Application No. 62/775,910 filed on Dec. 6 2018 under 35 U.S.C. § 119(e), the entire contents of all of which are hereby incorporated by reference.

BACKGROUND OF THE INVENTION

Field of the Invention

The present invention relates to an image display system, particularly to an image display system for transmitting analog images and a method for increasing data volume of a control signal thereof.

Description of the Related Art

The conventional image display system for transmitting analog high-definition (HD) images is shown in FIG. 1. The image display system includes an analog image transmitting device 10, an analog image receiving device 12, and a coaxial cable 14 connected devices 10 and 12. The device 10 includes a camera 16 configured to capture images and transmits an analog image signal to the device 12 via the coaxial cable 14. The analog image receiving device 12 may be implemented by a digital video recorder (DVR). A user can use the control interface or the control device (e.g., a remote control) of the device 12 to send out a control command for adjusting the angle of the camera 16, the brightness of images, etc. According to the control command, the device 12 generates and transmits a digital control signal to the device 10 through the coaxial cable 14. The analog image transmitting device 10 analyzes the received control signal. According to the analyzed content, the analog image transmitting device 10 adjusts settings, such as the angle of the camera 16 and the brightness of images, thereby outputting analog images with the adjusted setting. The image display system shown in FIG. 1 may be applied to a dashboard camera or a security monitoring system. A distance between the devices 10 and 12 may have several hundreds of meters in a security monitoring application. The strength of the control signal which is transmitted on the coaxial cable 14 will attenuate as the transmitting distance is increase. Consequently, the reliability of the control signal is influenced.

FIG. 2 is a diagram schematically showing the conventional timing sequence of the signal on the coaxial cable 14 when the conventional image display system transmits a frame of analog image. The timing sequence includes a vertical synchronization signal interval 20 for determining the beginning or the ending of each frame of image, a digital control signal interval 22 for transmitting a control signal, and an analog image interval 24 for transmitting an analog image signal. The timing sequence for transmitting the digital control signal doesn't overlap the timing sequence for transmitting the analog image signal so as to avoid the digital control signal and the analog image signal influence each other. When the frames per second (FPS) is fixed, the time for transmitting a frame of analog image is also fixed. When the data volume of the analog image signal increases with the increase of the resolution, it has to cost more time to transmit the analog image signal. In the conventional technology, the digital control signal interval 22 is shortened to increase the analog image interval 24. In such a case, the activity of transmitting the control signal does not be completed in a frame of image since the data volume of the control signal that can be transmitted is reduced. Instead, the activity of transmitting the control signal is completed in several frames of image. As a result, the user obviously has non real-time experience when controlling the analog image transmitting device. The conventional technology can't satisfy the requirement for fast response in some applications. In addition, the abovementioned drawbacks also limit the development of the applications requiring a great number of control commands or parameters in an image display system.

SUMMARY OF THE INVENTION

One of objectives of the present invention is to provide an image display system and a method for increasing a data volume of a control signal thereof.

One of objectives of the present invention is to provide an image display system and a method thereof, which use a vertical synchronization signal interval to transmit a control signal.

One of objectives of the present invention is to provide an image display system and a method thereof, which use a horizontal synchronization signal interval to transmit a control signal.

One of objectives of the present invention is to provide an encoding mode of a control signal to increase the data volume of the control signal transmitted by the image display system in a unit of time.

One of objectives of the present invention is to provide an image display system and a method thereof, which transmit an analog image signal and a control signal at the same time.

According to the present invention, an image display system comprises an analog image transmitting device configured to output an analog image signal, an analog image receiving device configured to receive the analog image signal and output a digital control signal to the analog image transmitting device, and a coaxial cable connected to the analog image transmitting device and the analog image receiving device. The timing sequence of a signal on the coaxial cable includes a vertical synchronization signal interval, a digital control signal interval, and an analog image interval during transmitting a frame of analog image. A method for increasing the data volume of the control signal comprises arranging a first additional control signal interval in the vertical synchronization signal interval without changing a time length of the vertical synchronization signal interval. The digital control signal interval and the first additional control signal interval are used for transmitting the control signal.

The method for increasing the data volume of the control signal may further comprise a step of arranging a second additional control signal interval in a horizontal synchronization signal interval of the analog image interval without changing a time length of the horizontal synchronization signal interval. The second additional control signal interval is used for transmitting the control signal.

In the method for increasing the data volume of the control signal, a signal cycle of the control signal may be integral multiple of at least two pixel clocks.

In the method for increasing the data volume of the control signal, a duty cycle of each signal cycle of the control signal may be used to represent encoding data transmitted during each signal cycle, wherein at least two bits is transmitted during each signal cycle of the control signal.

In the method for increasing the data volume of the control signal, the control signal and the analog image signal are transmitted at the same time to increase the time for transmitting the control signal. After the analog image receiving device receives a superimposed signal formed by superposing the control signal and the analog image signal, a subtractor in the analog image receiving device subtracts the control signal from the superimposed signal to obtain the analog image signal. After the analog image transmitting device receives the superimposed signal, the analog image transmitting device uses a preset voltage to process the superimposed signal so as to obtain the content of the control signal.

Below, the embodiments are described in detail in cooperation with the drawings to make easily understood the technical contents, characteristics and accomplishments of the present invention.

BRIEF DESCRIPTION OF THE DRAWINGS

FIG. 8 is a diagram schematically showing an embodiment of the time lengths of intervals according to the present invention;

FIG. 9 is a diagram schematically showing embodiments of horizontal synchronization signal intervals of different formats according to the present;

FIG. 21 is a diagram schematically showing the distribution of fisheye-image windows on a screen according to the present invention.

DETAILED DESCRIPTION OF THE INVENTION

Figure 3:
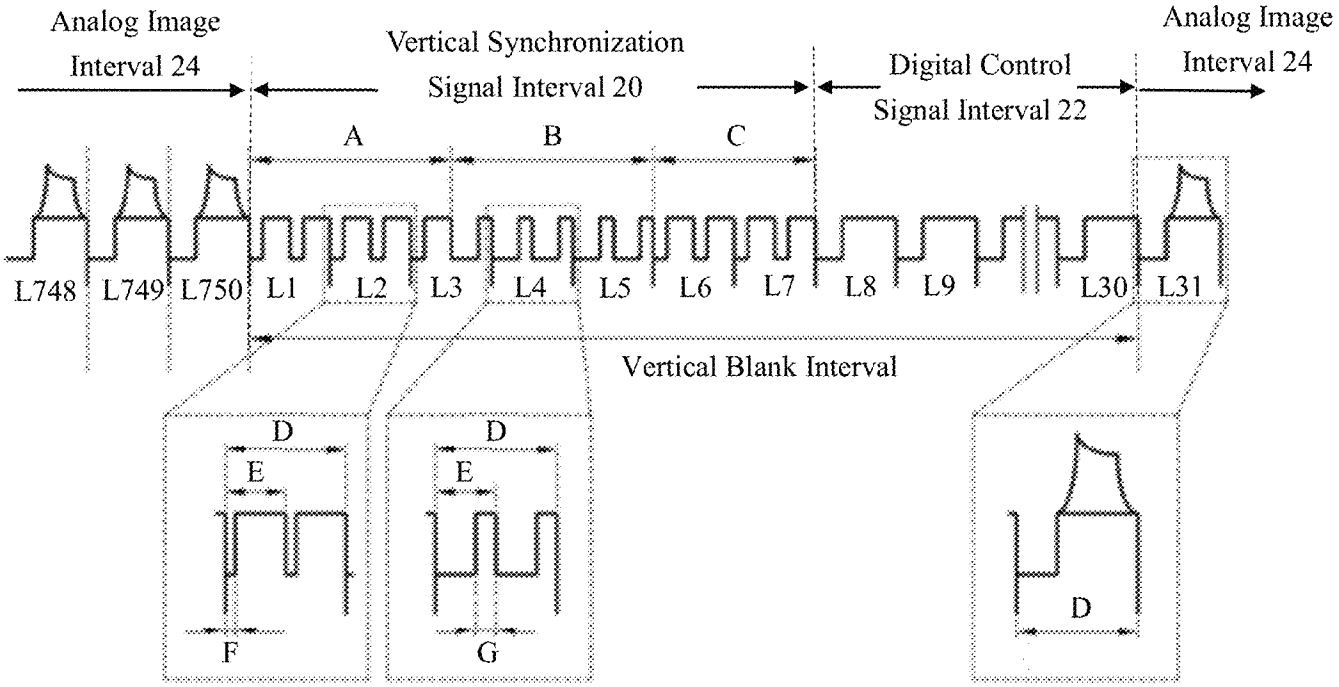
Fig. 3 Prior Art
FIG. 3 is a diagram schematically showing a vertical synchronization signal interval in the conventional technology.
Figure 4:
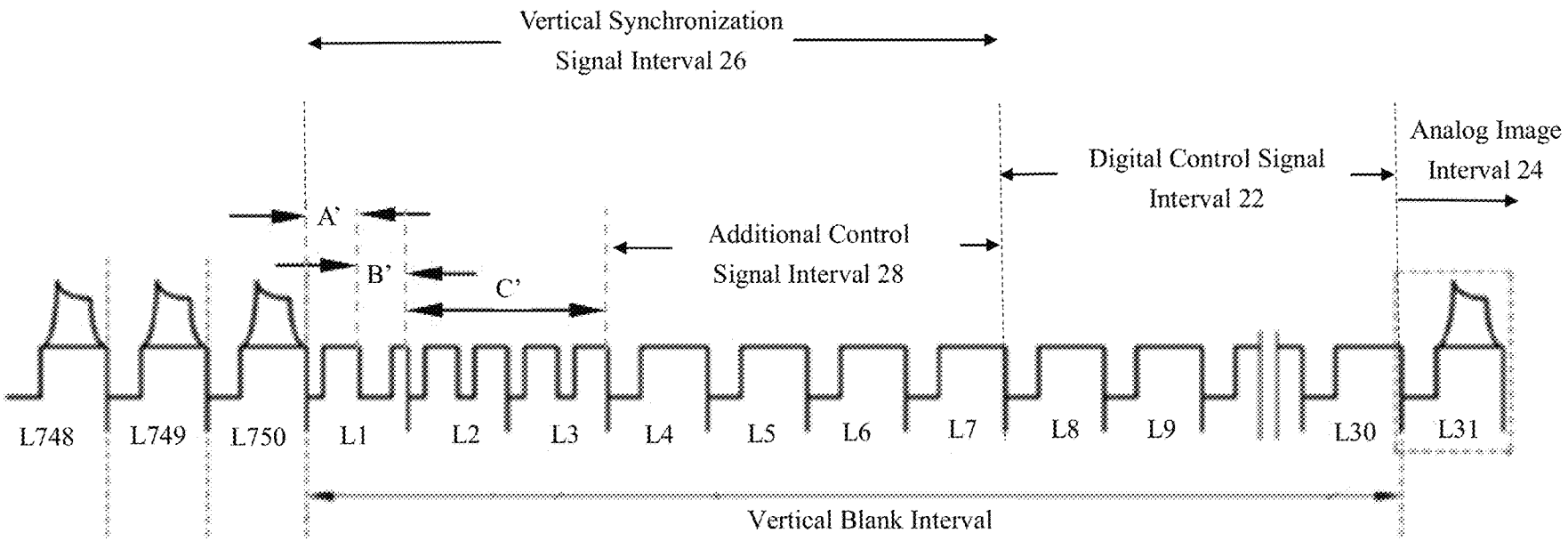
FIG. 4 is a diagram schematically showing an embodiment of a vertical synchronization signal interval according to the present invention.

FIG. 3 and FIG. 4 are used to introduce the first method for increasing the data volume of a control signal of the present invention. FIG. 3 is a diagram schematically showing a vertical synchronization signal interval 20 in the conventional technology. FIG. 4 is a diagram schematically showing an embodiment of a vertical synchronization signal interval 26 of the present invention. FIG. 3 and FIG. 4 exemplify an image having a resolution of 720P. The period of a frame of image includes the time of 750 scan lines SL1-SL750. The scan line, also called a horizontal scan line, is the basic element of the analog image signal. The scan line includes points sorted in a horizontal direction to form a line having color information. The scan line is named because the points are sorted from left to right. In FIG. 3 and FIG. 4, scan lines L1-L7 are called the vertical synchronization signal interval 20 or 26, scan lines L8-L30 are called a digital control signal interval 22, and scan lines L31-L750 are called an analog image interval 24. Besides, scan lines L1-L30 are alternatively called a vertical blank interval (VBI). The analog image signal is not transmitted in VBI but transmitted only in the analog image interval 24.

As shown in FIG. 3, the conventional vertical synchronization signal interval 20 is composed of a pre-equalizing pulse interval A, a vertical sync pulse interval B, and a post-equalizing pulse interval C. Each intervals D within the intervals A, B, and C has the time length of one scan line. Each intervals E has the time length of half a scan line. Thus, the time length of interval A is five times of the time length of half a scan line, the time length of interval B is five times of the time length of half a scan line, and the time length of interval C is four times of the time length of half a scan line. Each low-level intervals F within the intervals A and C is called an equalizing low pulse. Each high-level intervals G within the interval B is called a sync pulse. The functions of the intervals A, B, C, F, and G are well known by one of ordinary skill in the art so the details are omitted for brevity. The method for increasing the data volume of the control signal in the image display system according to the present invention shortens at least one of the intervals A, B, and C to obtain additional time for transmitting the control signal, thereby increasing the data volume of the control signal in a frame of image.

Figure 1:
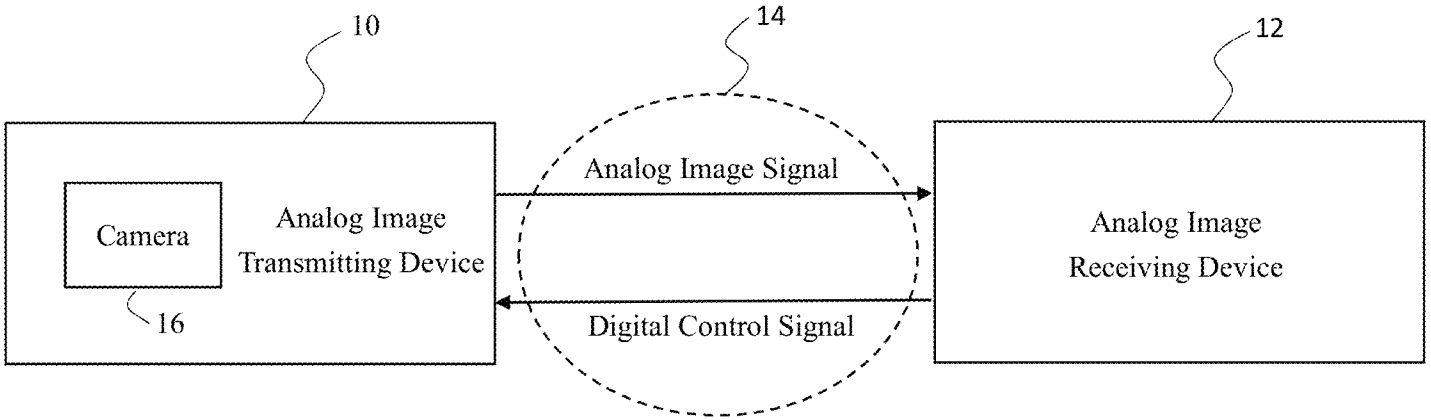
Fig. 1 Prior Art
FIG. 1 is a diagram schematically showing image display system in the conventional technology.

Refer to FIG. 1 and FIG. 4. The image display system of the present invention, as shown in FIG. 1, also comprises an analog image transmitting device 10, an analog image receiving device 12, and a coaxial cable 14. But both the time length of a pre-equalizing pulse interval A' and a vertical sync pulse interval B', as shown in FIG. 4, are the time length of half a scan line, which is reduced from the conventional time length being five times of the time length of half a scan line. The time length of a post-equalizing pulse interval C' is four times of the time length of half a scan line as the conventional technology. The pre-equalizing pulse interval A', the vertical sync pulse interval B', and the post-equalizing pulse interval C' only use the time of three scan lines L1-L3 of the vertical synchronization signal interval 26. Thus, the other scan lines L4-L7 of the vertical synchronization signal interval 26 are arranged as an additional control signal interval 28 for transmitting the control signal, thereby increasing the data volume of the control signal in a frame of image. The present invention can support the different frame rates, such as 24 fps, 25 fps, 30 fps, 50 fps and 60 fps, the different display formats, such as 720P and 1080P, and other expansions and variations.

Figure 5:
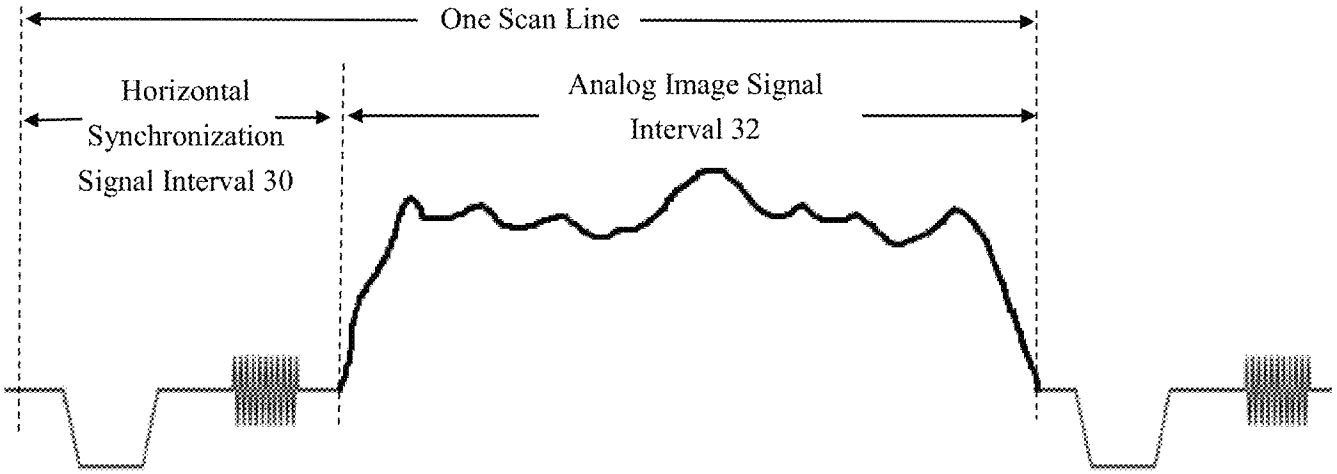
Fig. 5 Prior Art
FIG. 5 is a diagram schematically showing the timing sequence of one scan line in an analog image interval in the conventional technology.
Figure 6:
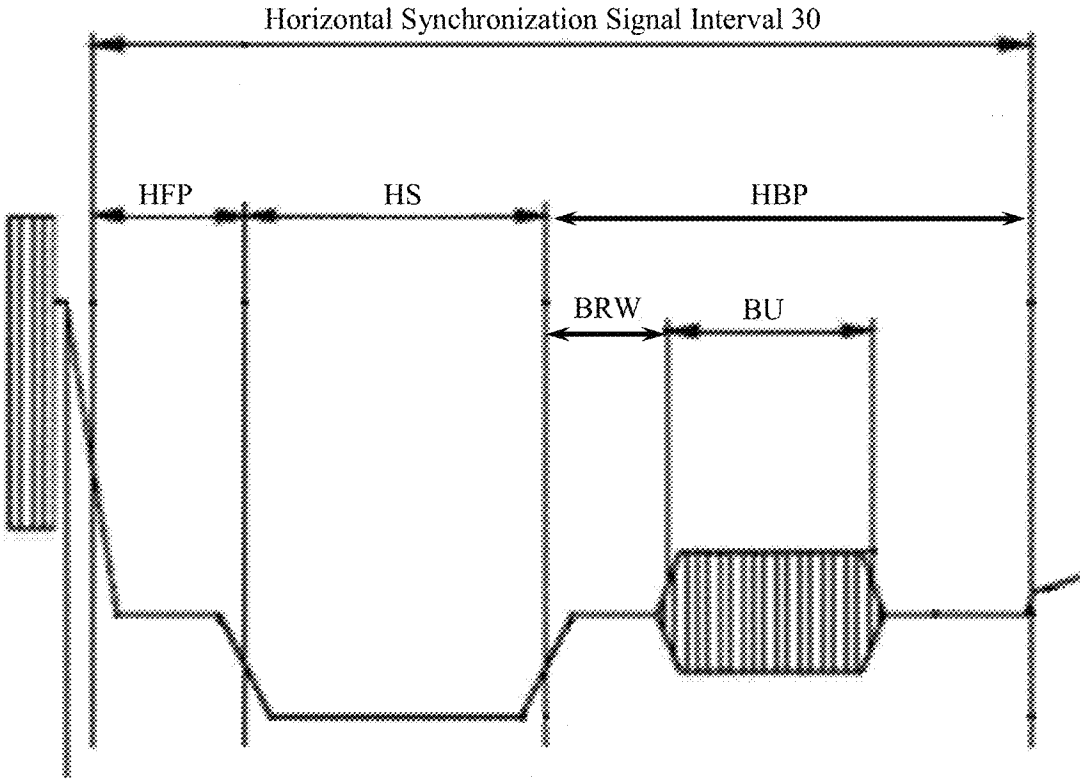
Fig. 6 Prior Art
FIG. 6 is a diagram schematically showing the timing sequence of a horizontal synchronization signal interval in the conventional technology.

FIGS. 5-9 are used to introduce the second method for increasing the data volume of a control signal according to the present invention. FIG. 5 shows the timing sequence of one scan line in the analog image interval 24 of FIG. 3, which includes a horizontal synchronization signal interval 30 and an analog image signal interval 32. FIG. 6 shows the timing sequence of the conventional horizontal synchronization signal interval 30, which includes a horizontal front porch interval HFP, a horizontal sync interval HS, and a horizontal back porch interval HBP, wherein the interval HBP includes a breeze-way interval BRW and a color burst interval BU. The functions of the intervals HFP, HS, HBP, BRW, and BU are well known by one of ordinary skill in the art so the details are omitted for brevity. The method for increasing the data volume of the control signal in the image display system according to the present invention shortens at least one of the intervals HFP, HS, HBP, BRW, and BU to obtain additional time for transmitting the control signal, thereby increasing the data volume of the control signal in a frame of image.

Figure 7:
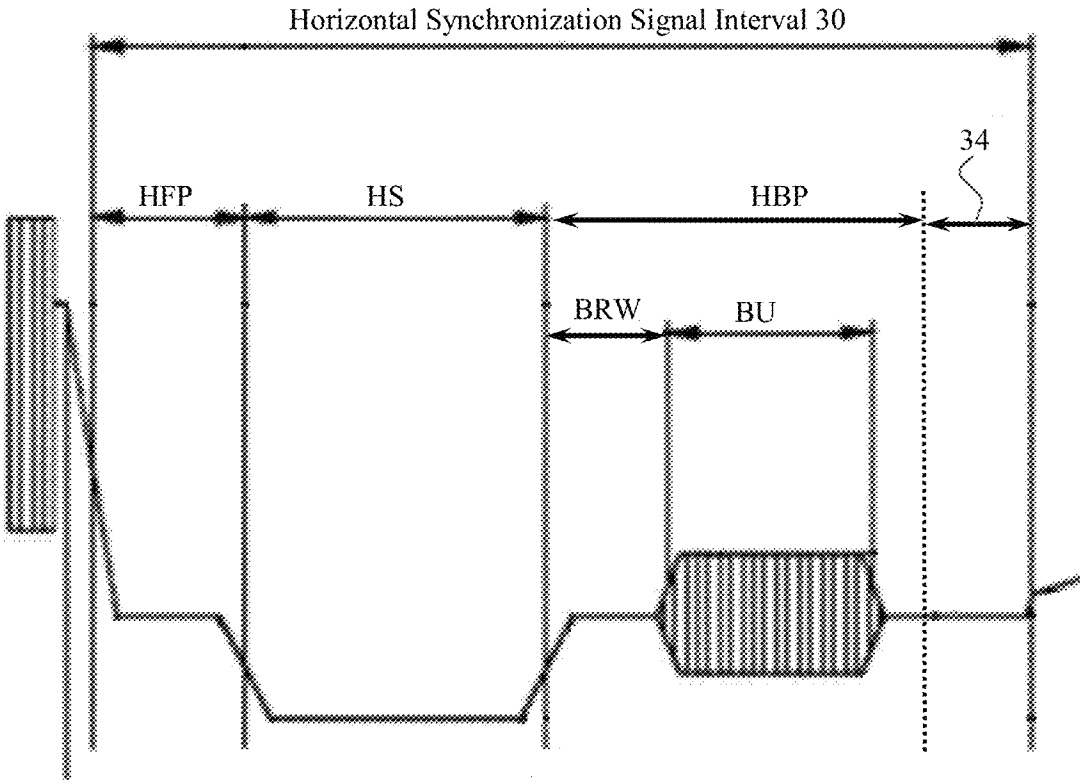
FIG. 7 is a diagram schematically showing the timing sequence of a horizontal synchronization signal interval according to the present invention.

FIG. 7 is a diagram schematically showing an embodiment of the timing sequence of a horizontal synchronization signal interval 30 according to the present invention. Like FIG. 6, the timing sequence of a horizontal synchronization signal interval 30 of FIG. 7 includes a horizontal front porch interval HFP, a horizontal sync interval HS, a horizontal back porch interval HBP, a breeze-way interval BRW, and a color burst interval BU. The lengths of the horizontal synchronization signal intervals 30 of FIG. 6 and FIG. 7 are the same. However, at least one of the intervals HFP, HS, HBP, BRW, and BU is shortened, such that the total length of the intervals HFP, HS, and HBP of FIG. 7 is shorter than the total length of the intervals HFP, HS, and HBP of FIG. 6. Thus, the horizontal synchronization signal intervals 30 of FIG. 7 has additional time arranged as an additional control signal interval 34 for transmitting the control signal, thereby increasing the data volume of the control signal in a frame of image. FIG. 8 is a diagram schematically showing the time lengths of the intervals HFP, HS, HBP, BRW, and BU of FIG. 6 and FIG. 7 for a resolution of 720P. As shown in FIG. 8, the time length of the conventional interval HFP of FIG. 6 is 23.70 μs and the time length of the interval HFP of the present invention is reduced to 1.24 μs, whereby the total length of the intervals HFP, HS, and HBP of FIG. 7 is shorter than the total length of the interval HFP, HS, and HBP of FIG. 6. The values shown in FIG. 8 are an embodiment of the present invention. The time lengths of the intervals HFP, HS, HBP, BRW, and BU of FIG. 7 can be adjusted by one of ordinary skill in the art according to requirements, such that the total length of the intervals HFP, HS, and HBP of the present invention is shorter than the total length of the intervals HFP, HS, and HBP of the conventional technology. Thus, the additional control signal interval 34 can be arranged. The present invention can not only apply to the common display specifications of 25 fps, 30 fps, 60 fps, 720P and 1080P, but also support expansions and variations of other image formats, such as variation/expansion 1 and variation/expansion 2 shown in FIG. 9.

The time length of the scan line and the analog image signal interval 32 are fixed when the frames per second (FPS) and the resolution are fixed. In other words, when the total length of the intervals HFP, HS, and HBP in the horizontal synchronization signal interval 30 is reduced, the additional control signal interval 34 is increased, such that the time length for transmitting the digital control signal is increased. In order to support the variation of the specification of the analog image signal, the subcarry frequency can be adjusted such that the interference of noise can be avoided when the analog image signal is transmitted through the coaxial cable 14, thereby the analog image receiving device 12 may correctly receive the analog image signal.

Figure 10:
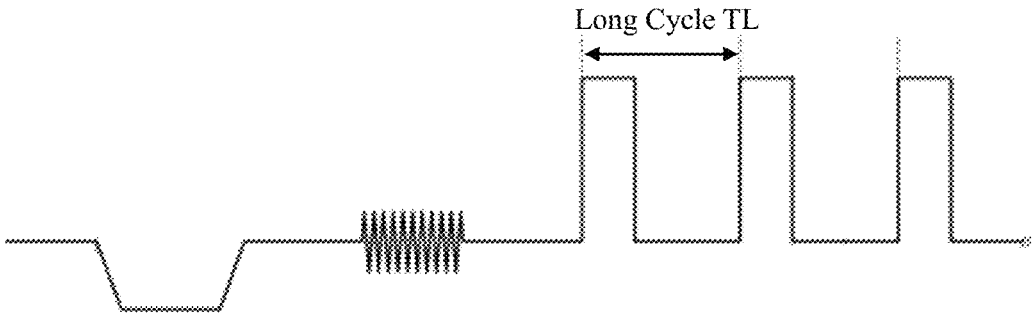
Fig. 10 Prior Art
FIG. 10 is a diagram schematically showing a digital control signal in the conventional technology.
Figure 11:
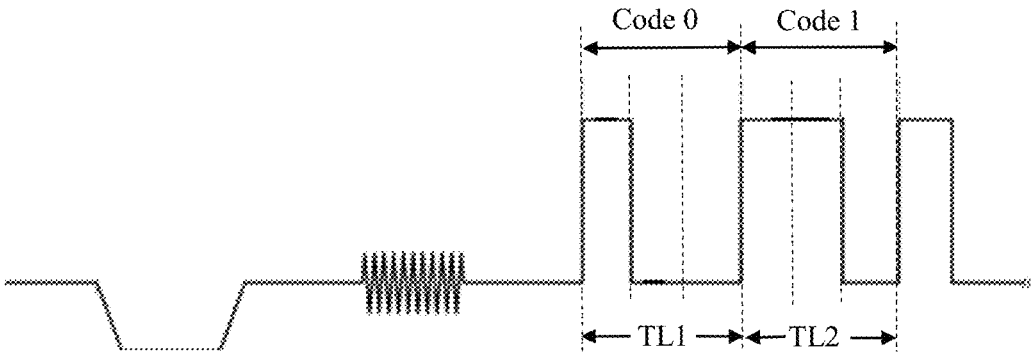
Fig. 11 Prior Art
FIG. 11 is a diagram schematically showing the encoding method of a control signal in the conventional technology.
Figure 12:
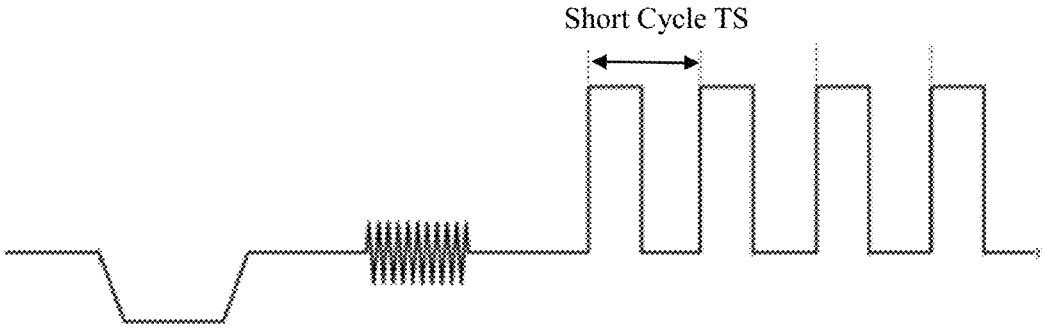
FIG. 12 is a diagram schematically showing a digital control signal according to the present invention.

FIGS. 10-12 are used to introduce the third method for increasing the data volume of a control signal of the present invention. FIG. 10 shows the conventional digital control signal having a longer signal cycle TL. Take 720P as an example, the signal cycle TL is 3 μs. FIG. 11 shows the encoding method of the conventional control signal, which divides each of the signal cycles TL1 and TL2 into three subintervals and the encoding data transmitted during the signal cycle is identified by comparing the time of the high-level voltage to the time of the low-level voltage during the signal cycle. For example, the levels in the three subintervals of the signal cycle TL1 are "high", "low", and "low", separately. So during the signal cycle TL1, the time of the high-level voltage is less than the time of the low-level voltage, which represents that the encoding data of the signal cycle TL1 is code "0". The levels in the three subintervals of the signal cycle TL2 are "high", "high", and "low", separately. So during the signal cycle TL2, the time of the high-level voltage is larger than the time of the low-level voltage, which represents that the encoding data of the signal cycle TL2 is code "1". FIG. 12 shows a digital control signal of the present invention having a shorter signal cycle TS. Thus, the control signal of the present invention transmits an encoding data in the shorter signal cycle TS. In other words, the present invention shortens the time for transmitting an encoding data. Taking the encoding method in FIG. 11 as an example, if the signal cycle TS of the present invention also has three subintervals but the period of each subinterval is 2 pixel clocks. Then, the signal cycle TS is three times of 2 pixel clocks. That is to say, the signal cycle TS is integral multiple of 2 pixel clocks. For 720P, one pixel clock is 1/74.25 MHz=0.01346 μs. Thus, the signal cycle TS=2*0.01346*3=0.08076 μs is greatly less than the conventional signal cycle TL=3 μs. During the period that the conventional control signal transmitting an encoding data, the control signal of the present invention can transmit 38 encoding data. The present invention can increase the data volume of the transmitted control signal per unit of time. In the embodiment, a subinterval has a period of 2 pixel cycles. In other embodiments, a subinterval has a period of more than 2 pixel cycles. In other words, the signal cycle TS of the present invention is integral multiple of at least two pixel cycles, wherein the signal cycle TS is less than the convention signal cycle TL.

Figure 13:
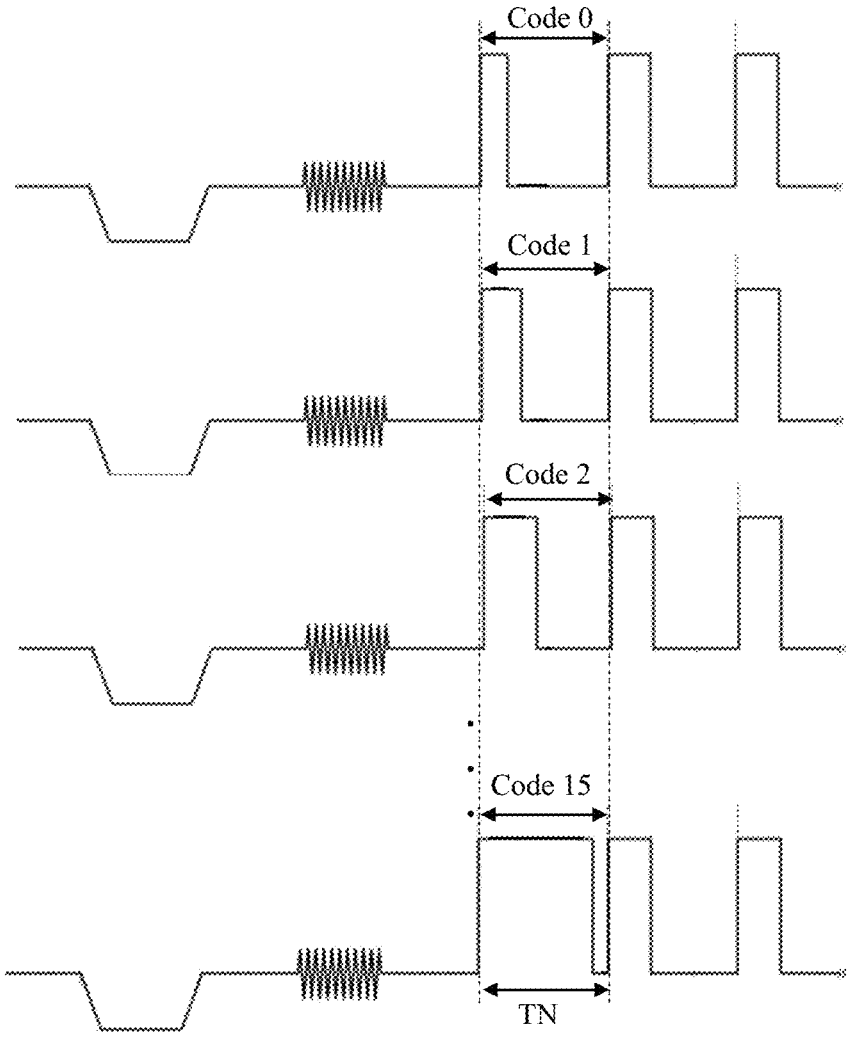
FIG. 13 is a diagram schematically showing the encoding method of a control signal according to the present invention.
Figure 14:
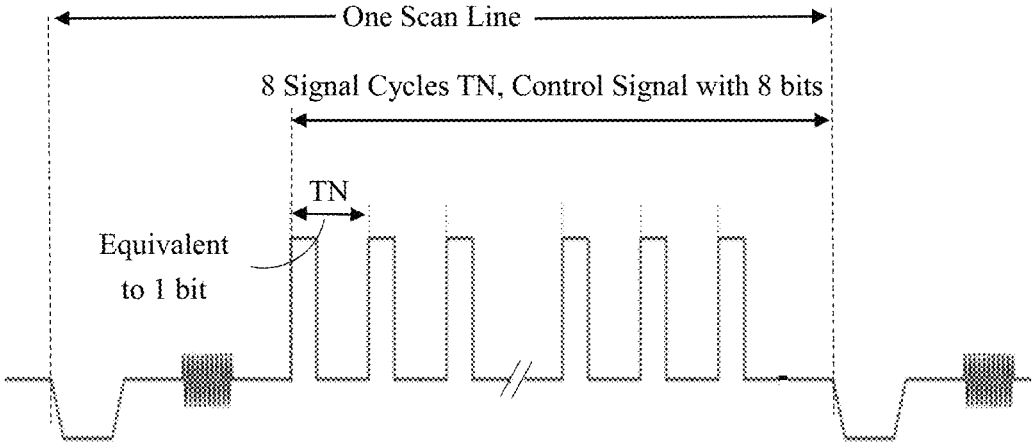
Fig. 14 Prior Art
FIG. 14 is a diagram schematically showing a control signal on one scan line in the conventional technology.
Figure 15:
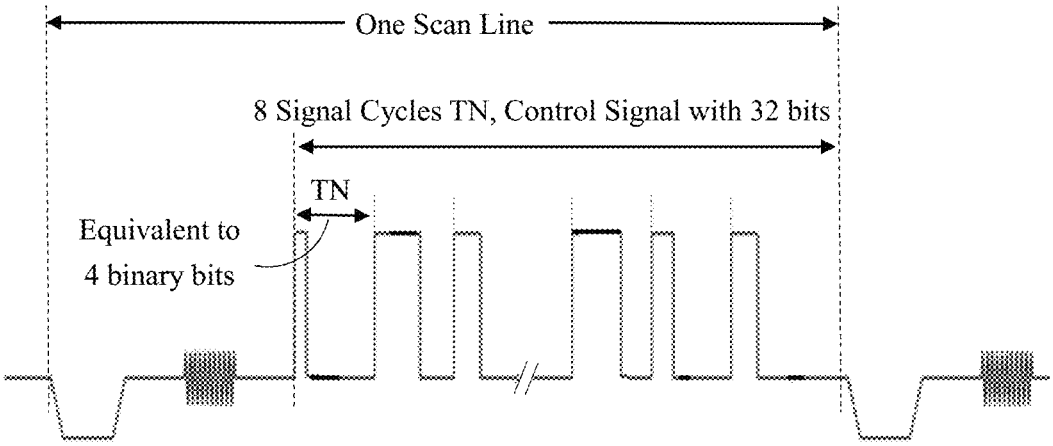
FIG. 15 is a diagram schematically showing a control signal on one scan line according to the present invention.

FIGS. 13-15 are used to introduce the fourth method for increasing the data volume of a control signal of the present invention. FIG. 13 shows the encoding method of a control signal of the present invention, which uses the pulse width modulation (PWM) technology to adjust the duty cycle of a signal cycle TN which representing the encoding data "0" to "15" transmitted during the signal cycle TN. In the embodiment of FIG. 13, the signal cycle TN of a control signal may have 16 types of duty cycles respectively corresponding to codes 0-15, which respectively represent binary data of "0000"-"1111". That is to say, a 4-bits data can be transmitted during one signal cycle TN, such that the data volume of the transmitted control signal is increased per unit of time. FIG. 14 shows the conventional control signal on one scan line, wherein the control signal has 8 signal cycles TN. In the conventional technology, only the code 0 or 1 can be sent out during one signal cycle to represent binary data of "0" or "1". In the conventional technology, only one bit of data can be transmitted during one signal cycle TN and one scan line transmits 8 bits of data. FIG. 15 shows a control signal on one scan line according to the present invention, wherein the control signal has 8 signal cycles TN. As shown in FIG. 13, each signal cycle TN can be used to transmit 4 bits of data. Thus, one scan line can transmit the 32 bits of data. That is, within the same time length, the data volume of the control signal of the present invention is 4 times of the data volume of the conventional control signal. In the embodiment, the signal cycle TN has 16 types of duty cycles. In other embodiments, the signal cycle TN may have more or less types of duty cycles. For example, the signal cycle TN has 32 types of duty cycles, which can be used to transmit 5 bits of data. Alternatively, the signal cycle TN has 4 types of duty cycles, which can be used to transmit 2 bits of data.

The embodiment of FIG. 12 may be combined with the embodiment of FIG. 13. Suppose that the signal cycle TN of FIG. 13 divided into 17 subintervals has 16 types of duty cycles and the period of each subinterval is 2 pixel clocks. For 720P, a pixel clock is 1/74.25 MHz=0.01346 μs and the signal cycle TN is about 0.458 μs. In the embodiment, the present invention can transmits 4 bits of data in 0.458 μs. Compared with the conventional technology which can only transmits 1 bit of data in 3 μs, the present invention increases the efficiency of transmitting the control signal by 26 times.

Figure 2:
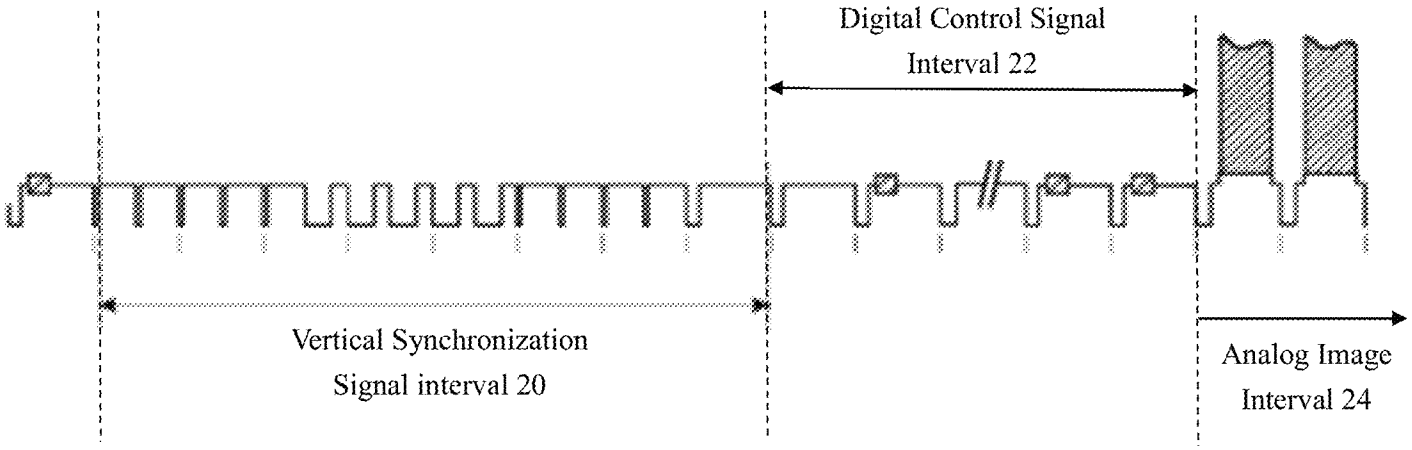
Fig. 2 Prior Art
FIG. 2 is a diagram schematically showing the timing sequence for transmitting a frame of analog image in the conventional technology.
Figure 16:
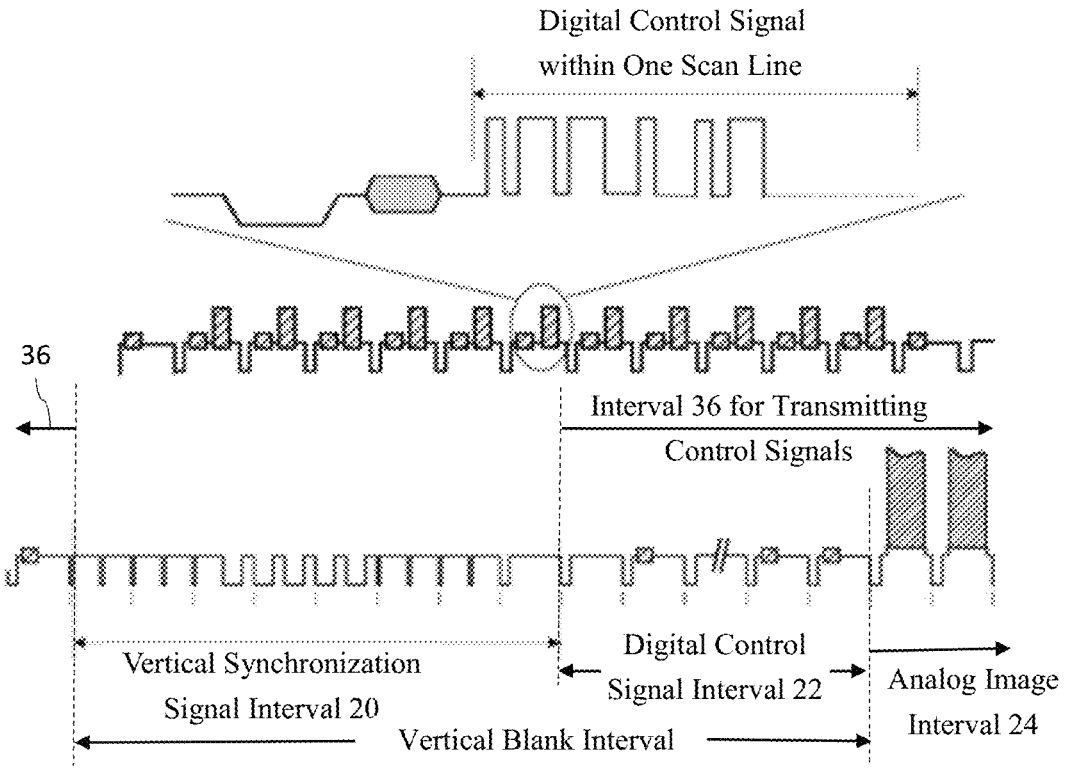
FIG. 16 is a diagram schematically showing the intervals can be used to transmit a control signal according to the present invention.

FIGS. 16-19 are used to introduce the fifth method for increasing the data volume of a control signal of the present invention. As shown in FIG. 2, the conventional image display system transmits the control signal within the digital control signal interval 22 which is after the vertical synchronization signal interval 20 and before the analog image interval 24. In other words, the conventional image display system separates the time of transmitting the control signal from the time of transmitting the analog image signal, lest the control signal be superposed onto the analog image signal to cause abnormal pictures and incorrectly reading the control signal. FIG. 16 shows an interval 36 where the image display system of the present invention can used to transmits the control signal. As shown in FIG. 16, the image display system of the present invention can transmit the control signal at any time except for the vertical synchronization signal interval 20, including those of the analog image interval 24. Even if the control signal and the analog image signal are transmitted at the same time, the control signal and the analog image signal can still be accurately retrieved. Therefore, the interval can be used to transmit the control signal become wider whereby more data of the control signal can be transmitted in a frame of analog image.

Figure 17:
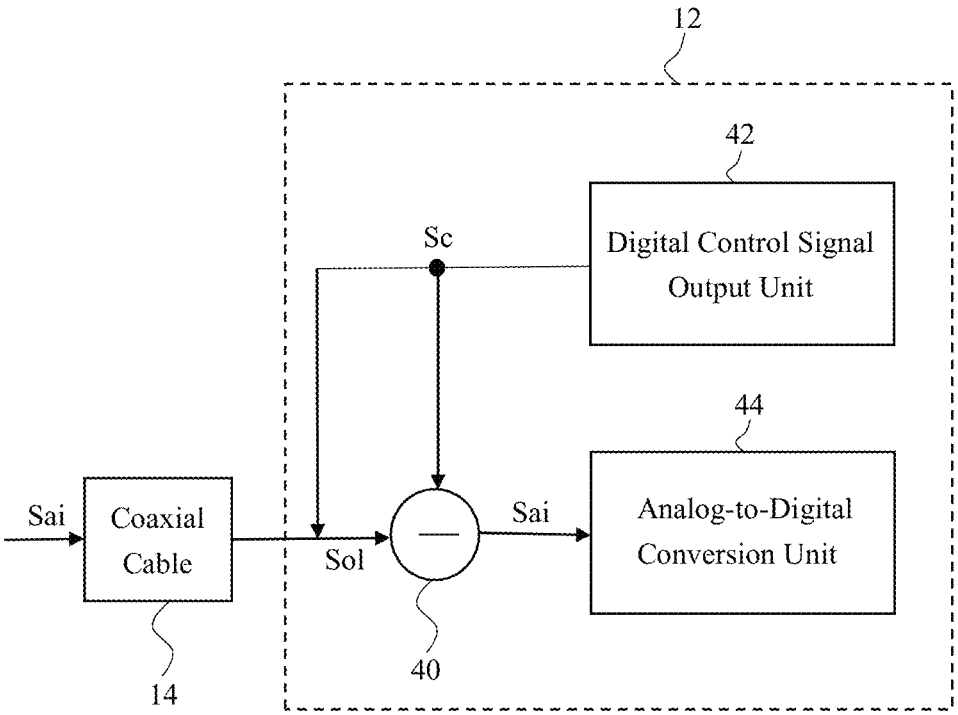
FIG. 17 is a diagram schematically showing an analog image receiving device of an image display system according to the present invention.
Figure 18:
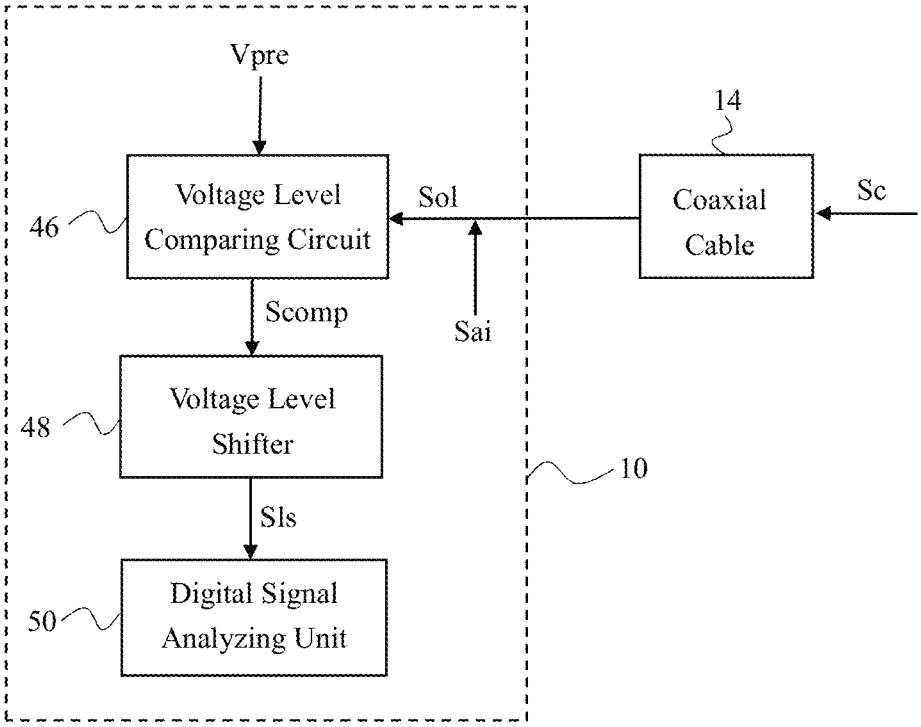
FIG. 18 is a diagram schematically showing an analog image transmitting device of an image display system according to the present invention.

FIG. 17 and FIG. 18 show an image display system for simultaneously transmitting a control signal and an analog image signal. FIG. 17 shows an analog image receiving device 12 in the image display system of the present invention. FIG. 18 shows an analog image transmitting device 10 in the image display system of the present invention. Refer to FIG. 17. The analog image receiving device 12 of the present invention comprises a subtractor 40, a digital control signal output unit 42, and an analog-to-digital conversion unit 44. The subtractor 40 is coupled to a coaxial cable 14, the digital control signal output unit 42, and the analog-to-digital conversion unit 44. The digital control signal output unit 42 outputs a control signal Sc to the analog image transmitting device 10 through the coaxial cable 14. When the control signal Sc and an analog image signal Sai are inputted to the coaxial cable 14 at the same time, the control signal Sc is superposed onto the analog image signal Sai to form a superimposed signal Sol. The subtractor 40 receives the superimposed signal Sol and subtracts the control signal Sc from the superimposed signal Sol to obtain the original analog image signal Sai. The analog-to-digital conversion unit 44 converts the analog image signal Sai outputted from the subtractor 40 into a digital signal, so as to display images on a display. Since the analog image receiving device 12 eliminates the control signal Sc from the superimposed signal Sol by the subtractor 40, the original analog image signal Sai can be obtained. Thus images can be correctly displayed in the analog image receiving device 12.

Refer to FIG. 18. The analog image transmitting device 10 comprises a voltage level comparing circuit 46, a voltage level shifter 48, and a digital signal analyzing unit 50. The voltage level comparing circuit 46 is coupled between the coaxial cable 14 and the voltage level shifter 48. The analog image transmitting device 10 outputs the analog image signal Sai to the analog image receiving device 12 through the coaxial cable 14. When the control signal Sc and the analog image signal Sai are inputted to the coaxial cable 14 at the same time, the control signal Sc is superposed onto the analog image signal Sai to form a superimposed signal Sol. The voltage level comparing circuit 46 receives the superimposed signal Sol and compares the superimposed signal Sol with a preset voltage Vpre to generate a comparison signal Scomp. In general, the voltage of the analog image signal Sai is less than 1.2 V and the voltage of the control signal Sc is higher than 1.2 V. Thus, the preset voltage Vpre can be set to 1.2 V to filter out the analog image signal from the superimposed signal Sol, thereby generating the comparison signal Scomp related to the control signal Sc. The preset voltage is set according to requirements. For example, the preset voltage is set to 1.2 V, but the present invention is not limited thereto. The voltage level shifter 48 receives the comparison signal Scomp from the voltage level comparing circuit 46 and converts the voltage of the comparison signal Scomp to generate a voltage level signal Sls. In an embodiment, the voltage level shifter 48 converts the voltage of the comparison signal Scomp to correspond to a working voltage of the analog image transmitting device 10, to generate a voltage level signal Sls. For example, the voltage of the comparison signal Scomp is converted into 2.5 V or 3.3 V. The digital signal analyzing unit 50 receives and analyzes the voltage level signal Sls to obtain the content of the control signal Sc. The voltage level comparing circuit 46, the voltage level shifter 48, and the digital signal analyzing unit 50 may be integrated in an integrated circuit (IC).

Figure 19:
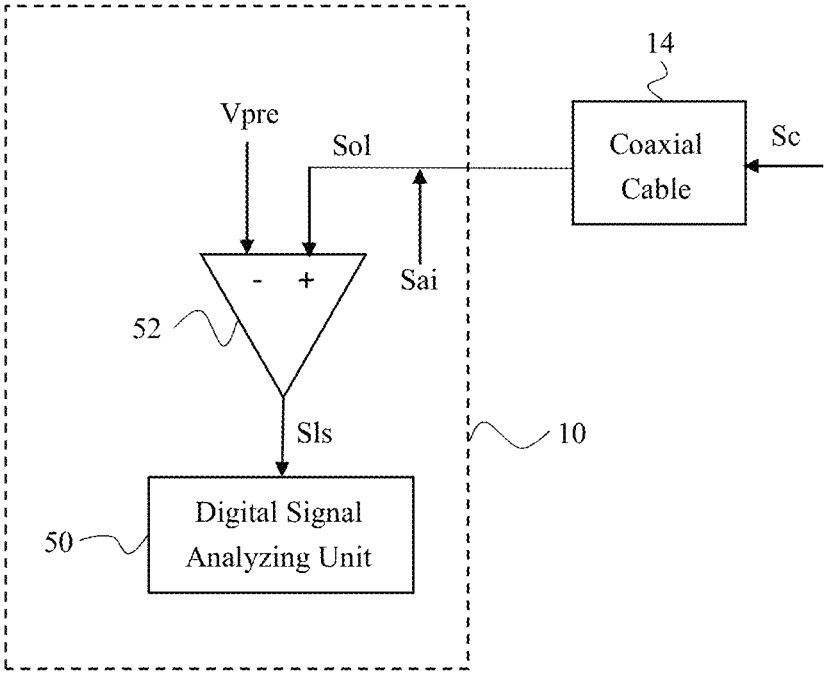
FIG. 19 is a diagram schematically showing another embodiment of the analog image transmitting device according to the present invention.

FIG. 19 shows another embodiment of the analog image transmitting device 10 of FIG. 18. The analog image transmitting device 10 in FIG. 19 comprises an operational amplifier 52 and a digital signal analyzing unit 50. The operational amplifier 52 receives the superimposed signal Sol and amplify a difference between the superimposed signal Sol and a preset voltage Vpre to generate a voltage level signal Sls, wherein the gain of amplifier 52 is designed such that the voltage of the voltage level signal Sls corresponds to the working voltage of the analog image transmitting device 10. The digital signal analyzing unit 50 receives and analyzes the voltage level signal Sls to obtain the content of the control signal Sc.

As mentioned above, the present invention provides several methods for increasing the data volume of the control signal in a frame of image. These methods can be independently used or combined with each other. For example, in an embodiment, the additional control signal interval 28 of FIG. 4 is arranged in the vertical synchronization signal interval 20, the additional control signal interval 34 of FIG. 7 is arranged in the horizontal synchronization signal interval 30, the control signal is encoded by the methods shown in FIG. 12 and FIG. 13, and the circuitry of FIG. 17 and FIG. 18 are applied such that the control signal Sc and the analog image signal Sai can be transmitted through the coaxial cable 14 at the same time.

Figure 20:
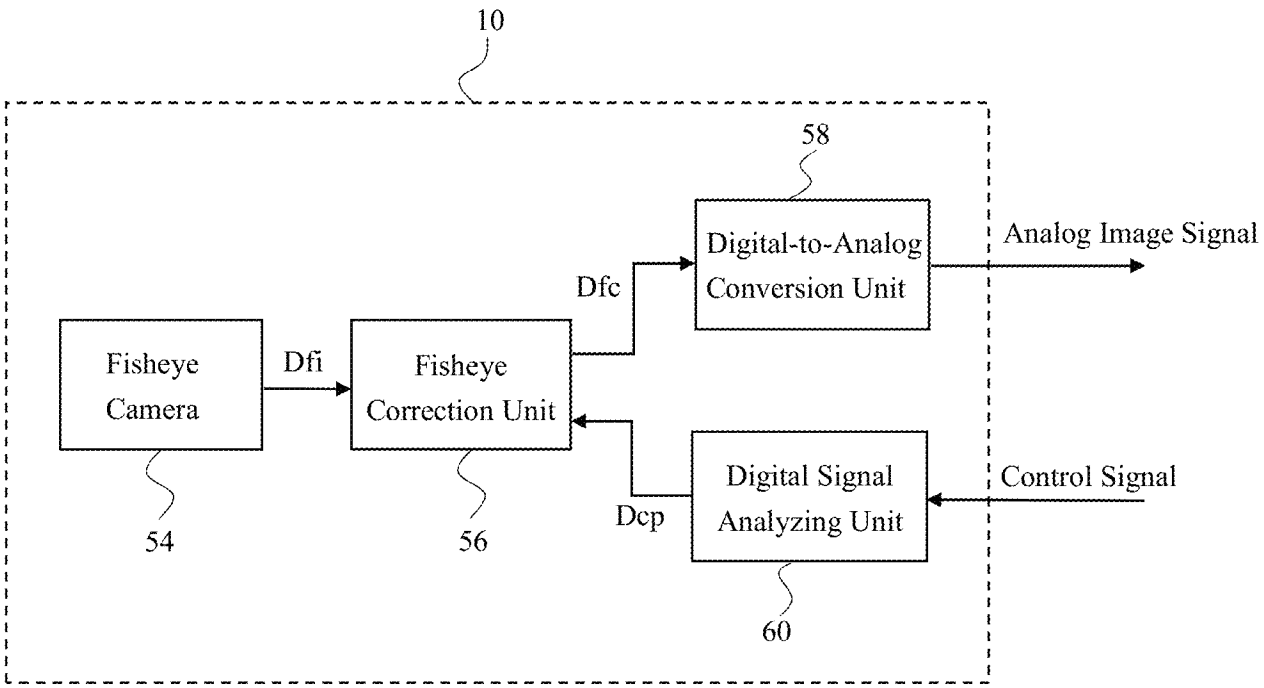
FIG. 20 is a diagram schematically showing an analog image transmitting device with fisheye-image correction function according to the present invention.

The method of the present invention can transmit more data of the control signal in a frame of image. As a result, in some applications requiring a huge amount of control signal and fast response, such as fisheye image correction, the image display system according to the present can achieve high-efficiency and real-time control. FIG. 20 shows an embodiment of an analog image transmitting device 10 with a fisheye image correction function. The analog image transmitting device 10 comprises a fisheye camera 54, a fisheye correction unit 56, a digital-to-analog conversion unit 58, and a digital signal analyzing unit 60. In an embodiment, the fisheye camera 54 has a view angle of 180 or more degrees and can captures 180 or more degree views to generate a fisheye image Dfi. The digital signal analyzing unit 60 is configured to decode the control signal outputted from the analog image receiving device 12 (not shown) to obtain an image correction parameter Dcp that a fisheye image correction process needs, and transmit the image correction parameter Dcp to the fisheye correction unit 56. The fisheye correction unit 56 comprises a fisheye correction algorithm. According to the image correction parameter Dcp, the fisheye correction unit processes the fisheye image Dfi with the fisheye correction algorithm so as to correct the fisheye image Dfi, and transmits the corrected digital image signal Dfc to the digital-to-analog conversion unit 58. The digital-to-analog conversion unit 58 converts the corrected digital image signal Dfc into the analog image signal and then sends out the analog image signal to the analog image receiving device 12 through the coaxial cable 14 (not shown). By the method of the present invention, the image correction parameter Dcp that the fisheye image correction process needs can be transmitted quickly (possibly be done in a frame of image), which helps the image display system using the fisheye lens achieve the real-time fisheye correction control. In this way, a fisheye lens may have more applications. For example, the blind spot detection (BSD) system of a vehicle may adopt fisheye lens to obtain real-time image information of oncoming vehicle at the vehicle side, which can apparently improve the driving security. Compared with the conventional blind spot detection system using radars, the cost of blind spot detection system using fisheye lenses is cheaper. In addition, the BSD system using fisheye lenses can obtain images at the vehicle side to develop more applications. The conventional BSD system using radars does not have this advantage.

The fisheye correction unit 56 performs fisheye correction functions including accelerating correction (Hw-acc), hemispherical to rectilinear image, horizontal panning, tilting, zooming in or out, flipping, mirroring, rotation, and multi-views. Thus, the control signal transmitted from the analog image receiving device 12 to the analog image transmitting device 10 includes the following parameters:

Image center position (x,y): the central position of a fisheye image;

Fisheye compensation/Panorama compensation parameter: a compensation parameter of a fisheye image or a panorama image (All the regions of a fisheye image or a panorama image may have different distortion, which require different compensation parameters);

Output window image width/height: the setting for the size of an output window for determine the height and the width of one window displayed in a screen;

Shift X/Y: for determining the position of a window displayed on a screen;

ROTATE_ANGLE: the rotating angles of a window and a corrected image;

keystone center X/Y: the central position of a trapezoid image for adjusting the trapezoid image;

zoom ratio: the ratio of zooming in or out an image;

optical center: the optical center of a fisheye lens;

outside/inside radius: for determining the correcting range of a 360-degree panorama fisheye image;

start angle: for determining a start point for converting a 360-degree panorama fisheye image to a rectilinear image;

angle range: for determining which part of a 360-degree panorama fisheye image to be converted to a rectilinear image.

The fisheye lens is used in the abovementioned embodiments, but the present invention is not limited thereto. Other wide-angle lens may also be applied to the present invention.

Figure 22:
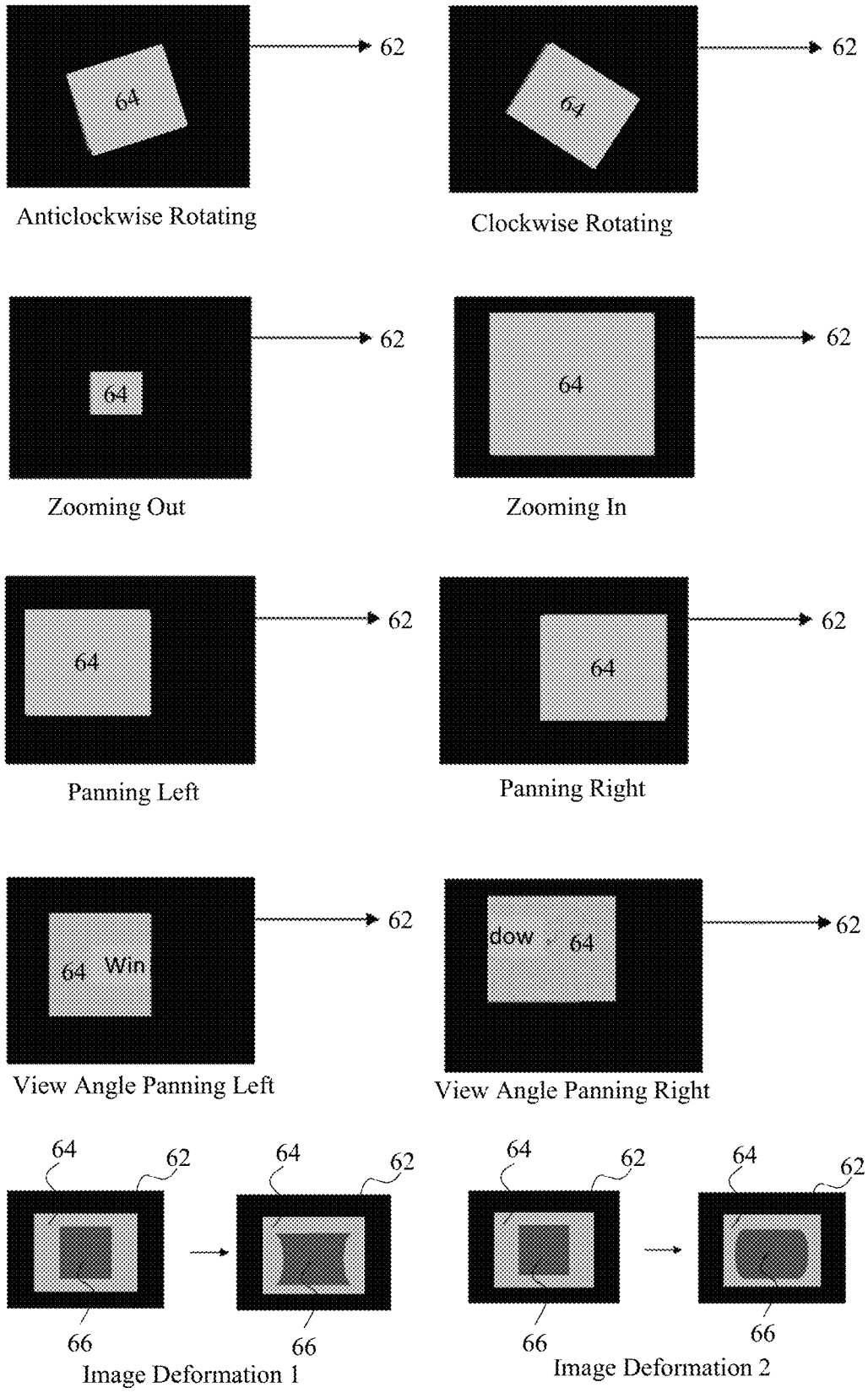
FIG. 22 is a diagram schematically showing the rotation, zooming, panning, and deformation of fisheye-image windows or pictures according to the present invention.

FIG. 21 and FIG. 22 illustrate the fisheye image correction and control performed by the present invention according to the abovementioned parameter. FIG. 21 shows the distribution of fisheye image windows displayed on a screen 62. The fisheye image is displayed on a single window 64. Alternatively, the fisheye image is divided into many parts and the parts of fisheye image are displayed on multiple windows 64, respectively. The user can adjust the position and the size of each window 64 or overlap the windows 64. FIG. 22 shows the rotation, zooming, deformation, and panning of picture converted from a fisheye image or windows The panning of pictures is achieved by adjusting the view angle of a fisheye lens. For example, a picture shows the word "window". After the view angle pans left such that the picture pans left, the picture only shows the word "win". FIG. 22 shows two embodiments of the deformation of pictures 66. Specifically, the left side and the right side of the square picture are inwardly recessed or outwardly protruded. FIG. 21 and FIG. 22 show some examples of the correction and the control of fisheye images. The image display system of the present invention also can achieve other correction and other control of the fisheye images not shown in FIG. 21 and FIG. 22.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A method for increasing a data volume of a control signal applied to an image display system, the image display system comprises an analog image transmitting device configured to output an analog image signal, an analog image receiving device configured to receive the analog image signal and output a digital control signal to the analog image transmitting device, and a coaxial cable connected to the analog image transmitting device and the analog image receiving device, timing sequence of a signal on the coaxial cable includes a vertical synchronization signal interval, a digital control signal interval, and an analog image interval during transmitting a frame of analog image, and the method comprises the steps of:

arranging a first additional control signal interval in the vertical synchronization signal interval without changing a time length of the vertical synchronization signal interval;

wherein the step of arranging the first additional control signal interval comprises shortening at least one of a pre-equalizing pulse interval, a vertical synchronization pulse interval, and a post-equalizing pulse interval of the vertical synchronization signal interval to produce the first additional control signal interval;

wherein the first additional control signal interval follows after the post-equalizing pulse interval;

wherein the first additional control signal interval is used to transmit the control signal.

2. The method for increasing the data volume of the control signal according to claim 1, wherein the first additional control signal interval sequentially follows after the post-equalizing pulse interval.

3. The method for increasing the data volume of the control signal according to claim 1, wherein the analog image transmitting device performs the steps:

generating a fisheye image by a fisheye camera;

receiving and decoding the control signal to obtain an image correction parameter;

correcting the fisheye image according to the image correction parameter, so as to generate a corrected digital image signal; and converting the digital image signal into the analog image signal.

4. A method for increasing a data volume of a control signal applied to an image display system, the image display system comprises an analog image transmitting device configured to output an analog image signal, an analog image receiving device configured to receive the analog image signal and output a digital control signal to the analog image transmitting device, and a coaxial cable connected to the analog image transmitting device and the analog image receiving device, timing sequence of a signal on the coaxial cable includes a vertical synchronization signal interval, a digital control signal interval, and an analog image interval during transmitting a frame of analog image, and the method comprises the steps of:

arranging a first additional control signal interval in the vertical synchronization signal interval without changing a time length of the vertical synchronization signal interval; and arranging a second additional control signal interval in a horizontal synchronization signal interval of the analog image interval without changing a time length of the horizontal synchronization signal interval;

wherein the vertical synchronization signal interval includes a post-equalizing pulse interval and a first additional control signal interval that follows after the post-equalizing pulse interval;

wherein the first additional control signal interval is used to transmit the control signal;

wherein the second additional control signal interval is used to transmit the control signal.

5. The method for increasing the data volume of the control signal according to claim 4, wherein the step of arranging the second additional control signal interval comprises shortening at least one of a horizontal front porch interval, a horizontal synchronization interval, a horizontal back porch interval, a breeze-way interval, and a color burst interval of the horizontal synchronization signal interval to produce the second additional control signal interval.

6. The method for increasing the data volume of the control signal according to claim 4, wherein the first additional control signal interval sequentially follows after the post-equalizing pulse interval.

7. The method for increasing the data volume of the control signal according to claim 4, wherein the analog image transmitting device performs the steps:

generating a fisheye image by a fisheye camera;

receiving and decoding the control signal to obtain an image correction parameter;

correcting the fisheye image according to the image correction parameter, so as to generate a corrected digital image signal; and converting the digital image signal into the analog image signal.

8. A method for increasing a data volume of a control signal applied to an image display system, the image display system comprises an analog image transmitting device configured to output an analog image signal, an analog image receiving device configured to receive the analog image signal and output a digital control signal to the analog image transmitting device, and a coaxial cable connected to the analog image transmitting device and the analog image receiving device, timing sequence of a signal on the coaxial cable includes a vertical synchronization signal interval, a digital control signal interval, and an analog image interval during transmitting a frame of analog image, and the method comprises the steps of:

arranging a first additional control signal interval in the vertical synchronization signal interval without changing a time length of the vertical synchronization signal interval;

wherein the vertical synchronization signal interval includes a post-equalizing pulse interval and a first additional control signal interval that follows after the post-equalizing pulse interval;

wherein the first additional control signal interval is used to transmit the control signal;

wherein a signal cycle of the control signal which is integral multiple of at least two pixel clocks.

9. The method for increasing the data volume of the control signal according to claim 8, wherein the first additional control signal interval sequentially follows after the post-equalizing pulse interval.

10. The method for increasing the data volume of the control signal according to claim 8, wherein the analog image transmitting device performs the steps:

generating a fisheye image by a fisheye camera;

receiving and decoding the control signal to obtain an image correction parameter;

correcting the fisheye image according to the image correction parameter, so as to generate a corrected digital image signal; and converting the digital image signal into the analog image signal.

11. A method for increasing a data volume of a control signal applied to an image display system, the image display system comprises an analog image transmitting device configured to output an analog image signal, an analog image receiving device configured to receive the analog image signal and output a digital control signal to the analog image transmitting device, and a coaxial cable connected to the analog image transmitting device and the analog image receiving device, timing sequence of a signal on the coaxial cable includes a vertical synchronization signal interval, a digital control signal interval, and an analog image interval during transmitting a frame of analog image, and the method comprises the steps of:

arranging a first additional control signal interval in the vertical synchronization signal interval without changing a time length of the vertical synchronization signal interval;

wherein the vertical synchronization signal interval includes a post-equalizing pulse interval and a first additional control signal interval that follows after the post-equalizing pulse interval;

wherein the first additional control signal interval is used to transmit the control signal;

wherein a duty cycle of each signal cycle of the control signal represents encoding data transmitted during the each signal cycle, and at least two bits is transmitted during the each signal cycle of the control signal.

12. The method for increasing the data volume of the control signal according to claim 11, wherein the first additional control signal interval sequentially follows after the post-equalizing pulse interval.

13. The method for increasing the data volume of the control signal according to claim 11, wherein the analog image transmitting device performs the steps:

generating a fisheye image by a fisheye camera;

receiving and decoding the control signal to obtain an image correction parameter;

correcting the fisheye image according to the image correction parameter, so as to generate a corrected digital image signal; and converting the digital image signal into the analog image signal.

14. A method for increasing a data volume of a control signal applied to an image display system, the image display system comprises an analog image transmitting device configured to output an analog image signal, an analog image receiving device configured to receive the analog image signal and output a digital control signal to the analog image transmitting device, and a coaxial cable connected to the analog image transmitting device and the analog image receiving device, timing sequence of a signal on the coaxial cable includes a vertical synchronization signal interval, a digital control signal interval, and an analog image interval during transmitting a frame of analog image, and the method comprises the steps of:

arranging a first additional control signal interval in the vertical synchronization signal interval without changing a time length of the vertical synchronization signal interval;

wherein the vertical synchronization signal interval includes a post-equalizing pulse interval and a first additional control signal interval that follows after the post-equalizing pulse interval;

wherein the first additional control signal interval is used to transmit the control signal;

wherein the analog image receiving device outputs the control signal to the analog image transmitting device when the analog image transmitting device outputs the analog image signal to the analog image receiving device.

15. The method for increasing the data volume of the control signal according to claim 14, wherein after the analog image receiving device receives a superimposed signal formed by superposing the control signal and the analog image signal, the method further comprises:

subtracting the control signal from the superimposed signal to obtain the analog image signal; and converting the analog image signal into a digital signal so as to display images on a display.

16. The method for increasing the data volume of the control signal according to claim 14, wherein after the analog image transmitting device receives a superimposed signal formed by superposing the control signal and the analog image signal, the method further comprises:

comparing the superimposed signal with a preset voltage to eliminate the analog image signal in the superimposed signal, thereby generating a comparison signal;

converting a voltage value of the comparison signal according a working voltage of the analog image transmitting device to generate a voltage level signal; and analyzing the voltage level signal to obtain a content of the control signal.

17. The method for increasing the data volume of the control signal according to claim 14, wherein after the analog image transmitting device receives a superimposed signal formed by superposing the control signal and the analog image signal, the method further comprises:

using a gain to amplify a difference between the superimposed signal and a preset voltage to generate a voltage level signal, wherein the gain is controlled such that a voltage value of the voltage level signal corresponds to a working voltage of the analog image transmitting device; and analyzing the voltage level signal to obtain a content of the control signal.

18. The method for increasing the data volume of the control signal according to claim 14, wherein the first additional control signal interval sequentially follows after the post-equalizing pulse interval.

19. The method for increasing the data volume of the control signal according to claim 14, wherein the analog image transmitting device performs the steps:

generating a fisheye image by a fisheye camera;

receiving and decoding the control signal to obtain an image correction parameter;

correcting the fisheye image according to the image correction parameter, so as to generate a corrected digital image signal; and converting the digital image signal into the analog image signal.

* * * * *